United States Patent [19]

Vosper et al.

[11] 4,286,945

[45] Sep. 1, 1981

[54] WALL FIRED DUCT HEATER

[75] Inventors: Ralph R. Vosper, San Jose, Calif.; Arie W. Spoormaker, Maassluis, Netherlands; Chester S. Binasik, Palo Alto; Norman E. Harthun, San Carlos, both of Calif.

[73] Assignee: Coen Company, Inc., Burlingame, Calif.

[21] Appl. No.: 73,348

[22] Filed: Sep. 7, 1979

[51] Int. Cl.[3] ..... F24H 1/00

[52] U.S. Cl. ..... 432/29; 431/171; 431/350; 432/222

[58] Field of Search ..... 431/171, 350; 432/222, 432/29

[56] References Cited

U.S. PATENT DOCUMENTS

| | | | |
|---|---|---|---|
| 3,366,373 | 1/1968 | Reed | 432/222 |
| 3,830,620 | 8/1974 | Martin | 431/350 |
| 3,958,922 | 5/1976 | Goodnight et al. | 432/222 |
| 3,995,991 | 12/1976 | Wilkinson | 432/222 |

*Primary Examiner*—John J. Camby

*Attorney, Agent, or Firm*—Townsend and Townsend

[57] ABSTRACT

A heater for heating gases such as turbine exhaust gases to facilitate the extraction of the heat energy carried by such gases or flue gases to reduce their corrosiveness. The heater is defined by burners installed on walls of the duct through which the gases flow. The burner can be operated with heavy fuel oil and uses no more primary air than is necessary to ignite the fuel oil atomized by the burner and sustain a flame. The flame is relatively long and narrow and is directed transversely to the gas flow into the duct. Upstream of the burner is a shield to protect the flame from the gas flow. The shield communicates with a register which collects an amount of gas sufficient to provide the balance of the combustion oxygen to fully combust all fuel. From the register the gas flows along inclined passages to the side of the shield facing the flame, the passages directing the gas in the direction of the flame and at an oblique angle in regard thereto. The flame shield is shaped to approximate the outline of the flame. Gas not collected by the register is guided by the shield past the flame so as to achieve a uniform heating of the gas and thereby prevent the formation of hot spots in the gas downstream of the heater.

47 Claims, 11 Drawing Figures

WALL FIRED DUCT HEATER

BACKGROUND OF THE INVENTION

The present invention relates to heaters for heating a stream of gas, such as relatively hot turbine exhaust gas or relatively cool flue gases.

It is well-known that exhaust gases in general and turbine exhaust gases in particular have a relatively high temperature. If such gases are discharged to the atmosphere, a large amount of energy is wasted. To effectively utilize the energy carried by such gases, say for the generation of steam, it has been proposed to heat the gases to raise their temperature. That steam can then in turn be employed to power steam turbines or for other advantageous uses. The term "exhaust gas" is used herein to designate a gas which typically has an elevated temperature, i.e. gas of a temperature higher than ambient temperature, and which further has an oxygen content less than that of air.

In the past, exhaust gases have been heated in a variety of ways. The most inexpensive way to heat exhaust gases, at least as far as the construction of the heater is concerned, is to employ natural gas or light oil burners which are conveniently placed inside the exhaust gas duct. Examples of such heaters are disclosed in U.S. Pat. Nos. 3,632,286 and 3,830,620.

The increasing scarcity of gas and high quality, e.g. highly refined, light weight fuel oil has made it necessary to use heavy oils such as No. 6 fuel oil for the operation of gas turbines. This dictates that exhaust gases be heated with the same heavy oils. U.S. Pat. No. 3,934,553 illustrates such an exhaust gas heater. Briefly, it provides that the burners, including their fuel nozzles, be mounted exteriorly of the exhaust gas duct so that the fuel and the nozzle are never directly exposed to the hot exhaust gases. In this manner, a potential clogging of the fuel lines to the nozzle due to an excessive heating thereof by the exhaust gas is prevented. Thus, the flame is formed at the wall of the duct and is projected towards the center thereof into the flow of hot exhaust gas. To prevent the flame from being extinguished by the exhaust gas flow, a flame shield is positioned immediately upstream of the burner so as to form a trough within which the flame can burn in a manner analogous to protecting a candle from being blown out by shielding it with one's arched hand against air drafts.

For maximum efficiency, it is desirable that as little outside air as possible be introduced into the duct to sustain the flame since such outside air proportionally cools the gas flow and since the purpose of the heater is to raise the exhaust gas flow to the desired level at which the heat energy in the gas can be used to generate steam, for example. Accordingly, the burners appear to operate with relatively low primary air, i.e. outside air mixed with the fuel in the burner and the '553 patent discloses to perforate the shield by including holes and passages therein which permit the flow of part of the exhaust gas "through" the shield to the flame so that combustion oxygen for the flame can be extracted from the exhaust gas.

A difficulty with this approach is that the burner becomes quite unresponsive to regulation, that is if the perforations in the shield are formed so as to provide the flame with sufficient oxygen for maximum operation, the perforations typically flow an excessive amount of exhaust gas to the flame when it operates in a turn-down mode. In fact, at that point, too much exhaust gas may penetrate the flame shield and the flame may become extinct. Thus, such heaters are not well adapted for use over a wide operating range.

Moreover, heaters of the type disclosed in the '553 patent have a tendency to unevenly heat the exhaust gas so that the gas downstream of the heater may exhibit hot spots which, in turn, may lead to a local overheating of the heat exchange surfaces over which the gas subsequently flows. Such uneven heating is the result of the provision of spaced apart shields which are formed so as to define a protective trough for a particular portion of the flame, typically its base proximate the burner where the flame is the widest. As the flame narrows towards its end, its tranverse dimension becomes less and less, yet the protective shield forms a barrier with the same cross-section as in the vicinity of the flame base. As a result, exhaust gas streaming through the center of the duct is heated relatively less than exhaust gas streaming past the sides of the duct on which the burners are mounted so that the center portion of the gas stream may become less heated than the peripheries thereof. This can adversely affect the overall operation of the duct heater and the associated heat exchange surfaces.

Thus, the most recent prior art exhaust gas heater seeks to devise a heater which can be operated with lower grade, heavier fuel oils instead of with the much more expensive and increasingly scarce light weight fuel oils and/or fuel gas. To avoid the clogging of fuel lines from the coking of the overheated heavy fuel oils, the burners were essentially mounted outside the exhaust gas duct and shields were provided to protect the flames.

Although flame shields of this type in general are nothing new and were previously employed to protect the flames of gas fired duct heaters, as is disclosed in U.S. Pat. Nos. 3,494,712 and 3,649,211 to Vosper and assigned to the assignee of the present application, the flame shields employed in connection with exhaust gas heaters of the type described in the above-referenced '553 patent simply constituted shields which were formed with only one function in mind, namely to serve as an anchor for the flame in the exhaust gas stream so as to prevent it from being blown in a downstream direction. However, for an efficient operation of the burner and a minimization of atmospheric pollution more is required of such shields since the shields, when placed in an exhaust gas stream, act as baffles or guides for the exhaust gas which channel the gas along numerous paths essentially about and past the flames of the heater. Thus, the shields can induce eddies on their downstream side which, if not controlled, can lead to an accumulation of carbon, soot and the like which can ultimately be discharged to the atmopshere and cause pollution; the shields determine how close the various exhaust gas streams come to the flame and, thereby, how evenly or unevenly the gas will be heated which, if not controlled, may lead to hot spots in certain portions of the gas flowing downstream of the heater and thus may damage heat exchange surfaces located there; and, most importantly, the shield and the above-discussed perforations determine to what extent and how combustion oxygen for the flames of the heater from sources other than outside air is supplied to them—in this regard, closest control is necessary if a complete and efficient combustion of all fuel is to be assured during all operating conditions of the burner.

The exhaust gas heater of the '553 patent does not take into account these aspects. As a result, the heater disclosed in the '553 patent is only fully satisfactory insofar as it is capable of heating the exhaust gases with heavy fuel oils without requiring the frequent cleaning of the burner and in particular its fuel supply lines. Its operating characteristics, operating range and efficiency, however, are less than fully satisfactory. Thus, there is presently a need for an exhaust gas heater capable of using heavy fuel oils which eliminates or at least significantly reduces the drawbacks encountered with prior art heaters of this type.

SUMMARY OF THE INVENTION

The present invention provides an exhaust gas heater operable with heavy fuel oils which, as was the case with prior art heaters of this type, has burners mounted to the wall of the exhaust gas duct. However, in contrast to the prior art, it utilizes flame shields to anchor the flame which are constructed so as to assure a substantially uniform heating of all portions of the exhaust gas, which allows a precise control of the amount of combustion oxygen fed to the flame either directly from the exhaust gas or, if that contains insufficient oxygen, wholly or partially with oxygen supplied from ambient air. The shield is further constructed so as to substantially eliminate all eddies on the downstream side of the shield to thereby essentially eliminate a build-up of carbon and soot which, if uncontrolled, can lead to the discharge of undesirable pollutants into the atmosphere.

Further, the heater of the present invention employs a burner especially adapted for use with heavy oils which forms a long, relatively narrow, pencil-shaped flame which extends as far as possible from the duct wall into the duct interior. This burner forms a flame which extends sufficiently deep into the duct so that for narrow ducts, it can span the entire width thereof, while for relatively wide ducts pairs of oppositely mounted burners form flames which extend from opposite walls to about the center of the duct so as to minimize large cross-sectional areas of the duct in which no flame is present and where, therefore, exhaust gas might be insufficiently heated.

In addition, the flame shield is constructed so that exhaust gas utilized as the supply of combustion oxygen for the flame is deflected in the direction of the flame so that it impinges thereon at an oblique angle relative to the axis of the flame. In this manner, the exhaust gas does not have the tendency of blowing the flame in a downstream direction but rather tends to lengthen the flame in a direction transverse to the exhaust gas flow which aids the uniform heating thereof.

Generally speaking, an exhaust gas heater constructed in accordance with the present invention has burners mounted to opposing walls of the duct. Depending on the overall duct width, the burners on opposing duct walls are either aligned (for relatively wide ducts) or they are staggered and interleaving (for relatively narrow ducts in which the flames can extend substantially fully across the full width thereof). A flame shield is mounted to the wall upstream of the burner and it extends generally parallel to the flame into the duct. It has an outline, that is a lateral extent perpendicular to the exhaust gas flow through the duct, which approximates the outline of the flame. Thus, the shield has a relatively wide base proximate the burner (in the vicinity of the base of the flame) and it is relatively narrow adjacent a free end of the shield remote from the burner.

Depending on the overall length of the shield, which in turn depends at least in part on the width of the duct, the longitudinal shield edges are either tapered over their entire length or for long shields, a portion of the shield adjacent its base has parallel edges. In the latter instance the edges are tapered from a point spaced from the duct wall to which the shield base is mounted.

The shield is integrally constructed with a register disposed immediately upstream of the shield and in fluid communication with passages extending through the shield so that combustion oxygen can be supplied to the flame from the register. The register itself includes an opening disposed in the duct and facing in an upstream direction so that exhaust air can flow into the register. The opening includes suitable damper plates for regulating the amount of exhaust gas that can flow into the register to thereby regulate the amount of combustion oxygen supplied to the flame. This enables one to accurately regulate and control the supply of combustion oxygen over the operating range of the burner.

In one embodiment of the invention, the register can be connected with an alternative air supply, or it may be solely connected with a combustion air supply for instances in which the exhaust gas carries insufficient oxygen or where such a construction is otherwise desirable. The latter arrangement is particularly adapted for instances in which the exhaust gas is a flue gas which may have an oxygen content of as little as 1%.

The passages which communicate the register with the downstream (flame) side of the shield are preferably obliquely inclined relative to the axis of the flame by an angle of no more than 45° and preferably by an angle as small as 30° so that the exhaust gas or air supplied to the flame flows in the direction of the flame and thereby lengthens the flame for the above-discussed advantages.

In the preferred embodiment of the invention, the flame shield itself is mounted to a suitable support such as a pipe spanning across the duct and its outline facing the exhaust gas stream is generally trapezoidal that is relatively wide at the base (with or without a base section having parallel edges as above-discussed) and relatively narrow at the free end of the shield in conformity with the outline of the flame. Moreover, in cross-section, the flame shield preferably has a V-shaped configuration which terminates in flow directing plates which are substantially parallel to the gas flow between the plates to substantially reduce or eliminate turbulence in the exhaust gas flow past the shields. This substantially reduces or eliminates the formation of eddies on the flame side of the shield which, in turn, prevents carbon, soot and the like deposit on that side.

The transverse extent of the flame shield is selected so that it is slightly less than the corresponding transverse extent of the flame. As a result, peripheral portions of the flame protrude past the flame shield into the (projections of) the paths for the exhaust gas between the flame shields and over the entire length of the shields. Uniform heating of all portions of the exhaust gas stream is thereby obtained. For relatively wide exhaust gas ducts in which burners mounted to opposite duct walls are aligned so that their flames terminate proximate the center of the duct generally diamond-shaped baffle plates can be provided so as to reduce the amount of gas flowing through that center section where otherwise relatively less heating would take place. A relative underheating of the central portion of the gas flow in even wide ducts is thus prevented.

The above-described exhaust gas heater has excellent operating characteristics. The nozzle, though fired with heavy fuel oil and low pressure air, as is more fully discussed below, has a turn down ratio of up to 10:1 while maintaining a flame temperature of at least about 870° C. and operating with exhaust gases having a temperature range of between about 250° C. and 530° C. (with correspondingly varying amounts of oxygen in the exhaust gas). Since the supply of exhaust gas to the flame via the register and the shield passages can be modulated irrespective of the exhaust gas flow rate the burner itself can be fired with a minimum amount of primary air, typically in the range of no more than about 10 to 15%, all other oxygen being taken directly from the exhaust gas. Thus, the heater requires relatively little air for operation over its full operating range and exhibits a high efficiency irrespective of the burner load, i.e. irrespective of the turndown ratio at which the burner is fired. Yet, the heater is quickly converted for operation with air only, should that become necessary, by directing air into the register and closing the register to the exhaust gas stream.

The present invention makes it further possible to alternatively operate the duct heater with fuel oil or with gas. Although gas operation is normally no longer desirable, under certain circumstances and especially in certain locations where gas might be readily and inexpensively available the ability of the heater to operate with alternative fuels might be highly advantageous.

Consequently, the present invention provides an exhaust gas heater which is ideally suited for today's operating environment and available heating fuels. It is thus ideally suited for heating turbine exhaust gases (with a relatively high oxygen content) so that such gases can be used for secondary steam generation or low oxygen content, relatively cool flue gases to reduce or eliminate their corrosiveness.

DESCRIPTION OF THE PREFERRED EMBODIMENTS

Figures 2, 3, 8:
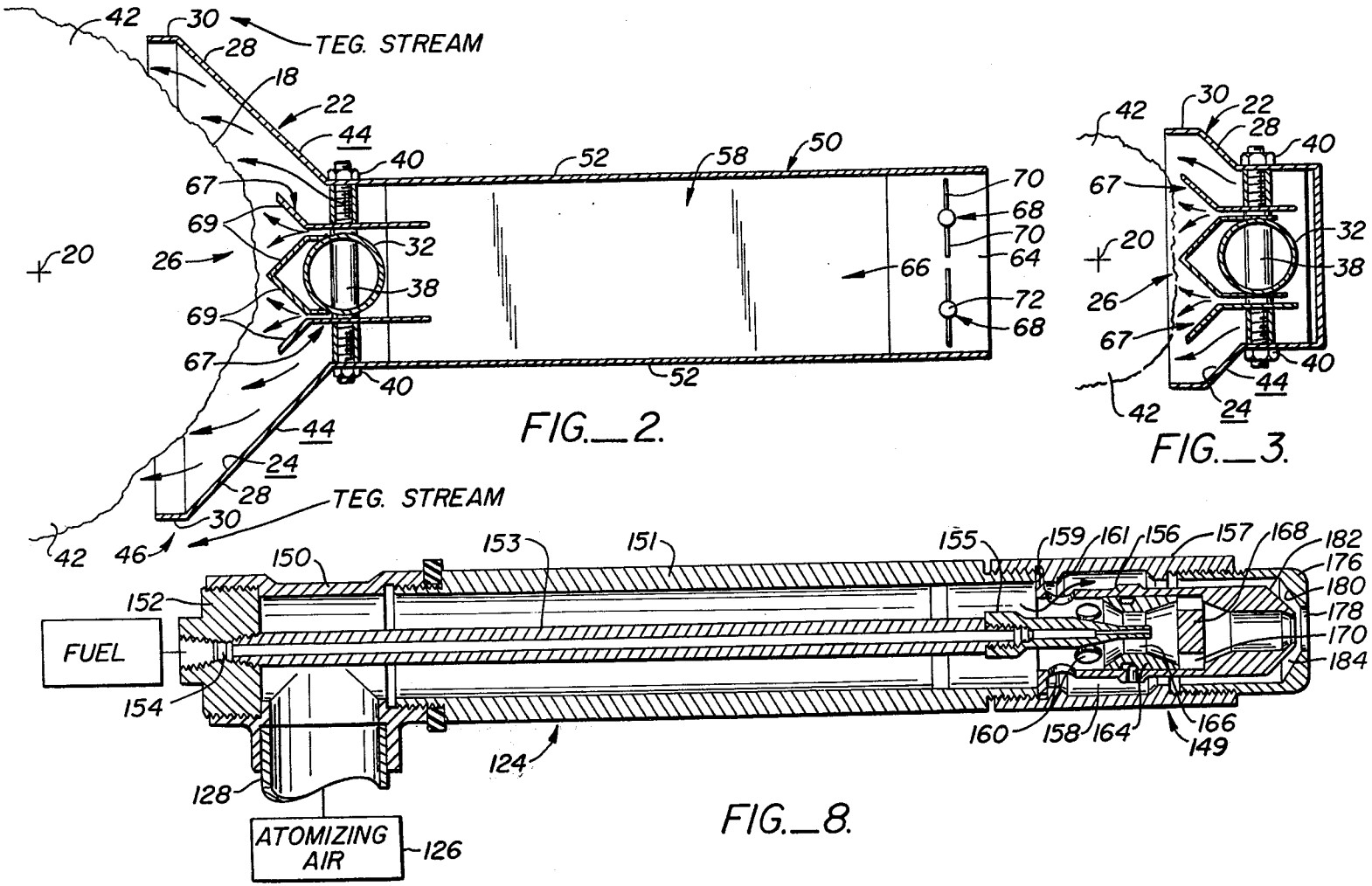
FIG. 2 is a cross-sectional side elevational view of a flame shield and a combustion oxygen supply register constructed in accordance with the present invention and is taken proximate the base of the shield and of the flame along line 2—2 of FIG. 1.
FIG. 3 is a view similar to FIG. 2 and is taken along line 3—3 of FIG. 1 proximate a free end of the shield which is remote from the associated burner.
FIG. 8 is an enlarged, side elevational view of the nozzle utilized by the burner illustrated in FIG. 7.
Figure 4:
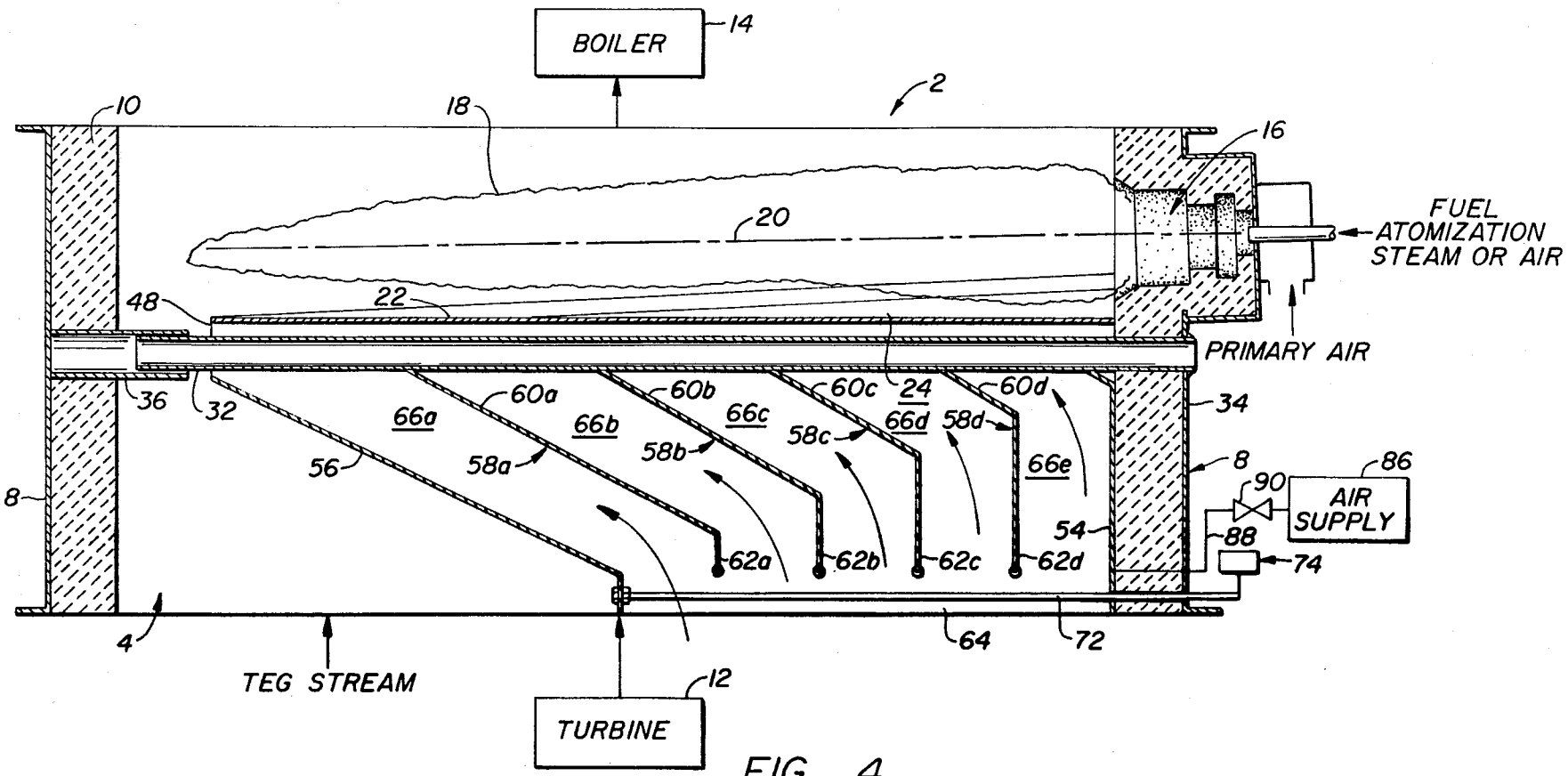
FIG. 4 is a plan view, in section, of the flame shield and the register illustrated in FIGS. 2 and 3.

Referring to FIGS. 1–4, an exhaust gas heater 2 constructed in accordance with the present invention is installed in a duct 4 through which the exhaust gas, for example turbine exhaust gas (TEG) flows in a downstream direction as is indicated by the arrow in FIG. 4. The duct is defined by parallel upper and lower horizontal duct walls 6 which are interconnected by a pair of opposing upright duct walls 8. The duct is conventionally lined with refractory bricks 10. Exhaust gas from a turbine 12, for example, flows towards the heater at a temperature which typically ranges between about 250° C. and 530° C. The heater raises the exhaust gas temperature, preferably to at least about 870° C. and frequently to as much as 1000° C. and the heated exhaust gas then contacts suitable heat exchange surfaces such as the pipes (not shown) of a boiler 14 to generate steam, for example, while the exhaust gas is cooled down to a temperature at which no further heat can be economically extracted from it. The gas is then conventionally discharged to the atmosphere.

Figure 1:
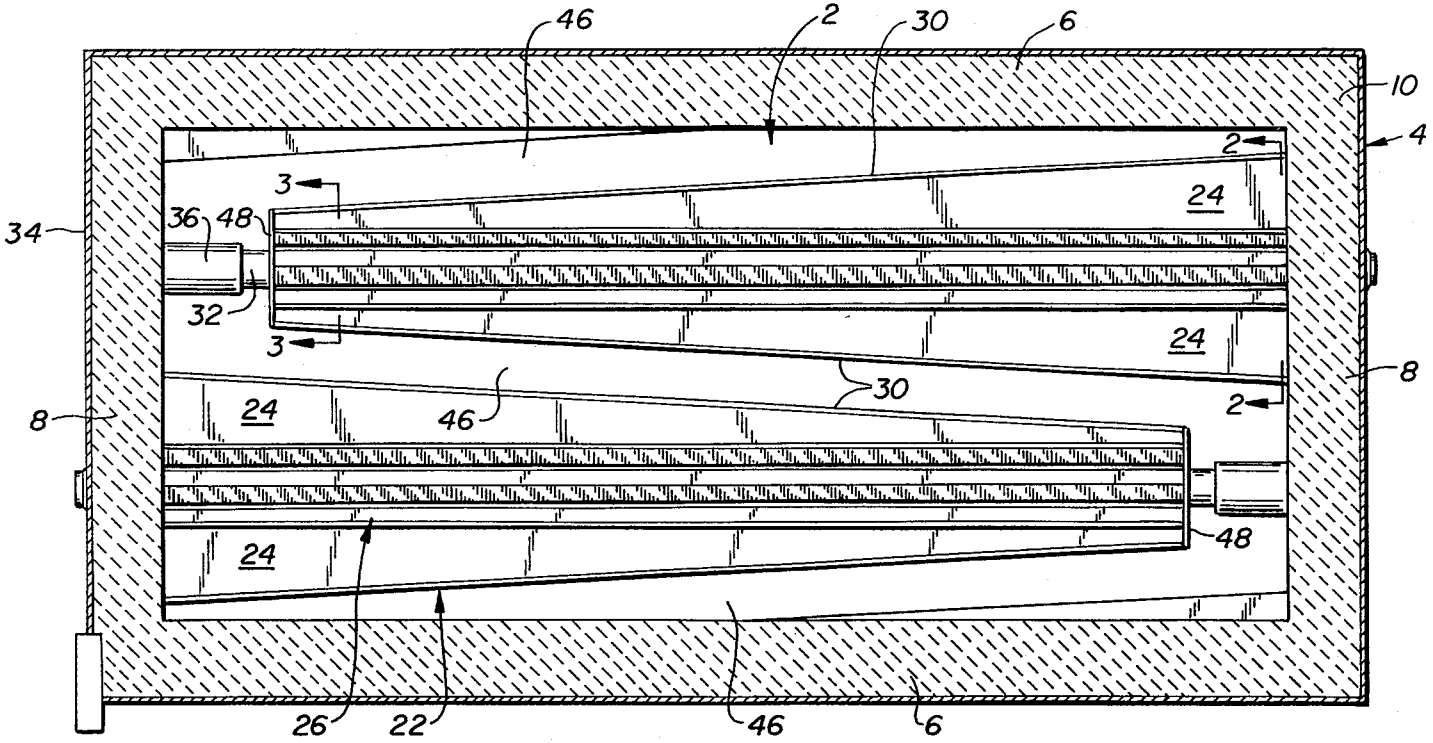
FIG. 1 is a cross-sectional view through a relatively narrow exhaust gas duct fitted with an exhaust gas heater constructed in accordance with the present invention.

The exhaust gas heater 2 principally comprises burners 16 which are constructed as further described below and which generate an elongated, relatively narrow, pencil-shaped flame 18 that extends along the burner axis 20 transversely to the TEG stream from one upright burner wall 8 towards the opposite duct wall. For relatively narrow duct walls the flame may be sufficiently long to extend substantially completely across the width of the duct as is illustrated in FIGS. 1 and 4. In such a case, the burners are mounted in a common plane (which is perpendicular to the TEG stream) and they are staggered or offset with respect to each other as is apparent from FIG. 1.

A flame shield 22 is associated with each burner and is positioned upstream thereof so as to define on a downstream or flame side 24 of the shield a trough 26 within which the flame burns and where the flame is protected from the TEG stream so that the flame, instead of being deflected towards the boiler or extinguished by the stream can burn and form a flame pattern or outline as generated by the burner without interference from the TEG stream.

In the preferred embodiment of the invention, the shield is defined by a pair of angularly inclined shield plates 28 which diverge in a downstream direction (see FIG. 2) and which terminate in spaced apart guide plates 30 which are parallel to the TEG flow direction through the duct. A pipe 32 is mounted to the duct, preferably by affixing, e.g. welding one end of the pipe to a suitable member of the duct such as an exterior duct plate 34 while supporting the other end of the pipe in a sleeve 36 projecting from the opposite duct wall which permits the pipe to thermally expand and contract. Upright studs 38 are distributed over the length of the pipe and they, together with nuts 40 secure the inclined shield plates to the pipe so that the pipe positions and supports the flame shield in the duct at the desired location and orientation.

The elongated flame 18 has a pencil-shaped configuration as is schematically illustrated in FIG. 4 and it has its largest diameter in the vicinity of its base proximate burner 16 and its smallest diameter at its opposite end. To assure a thorough yet uniform heating of the exhaust gas it is desirable that the flame shield be constructed so that peripheral portions 42 of the flame (see FIGS. 2 and 3) project beyond guide plates 30. As a result, in use when the TEG stream flows over the upstream side 44 of the flame shield and through the path 46 between adjacent flame shields, the stream intersects the peripheral flame portions and a maximum heat transfer takes place.

Since the flame diameter decreases from its base portion (proximate the burner) to its end and to assure a substantially uniform contact between the exhaust gas stream and the peripheral flame portions, the transverse extent of the shield facing the gas stream or, as viewed in FIG. 1 the height of the flame shield decreases correspondingly so that the guide plates 30 of the flame shield converge towards a free end 48 of the shield and the entire flame shield has a trapezoidal outline relative to the gas stream as is best seen in FIG. 1.

A register 50 is positioned upstream of flame shield 22 and is defined by a pair of spaced apart plates 52 which extend rearwardly from an end of the inclined shield plates 28 and which may be integrally constructed therewith. A side of the register proximate the base of the flame is defined by a plate 54 which abuts the refractory lining of the adjoining wall 8 while another side 56 of the register proximate the free end 48 of the shield is defined by a plate 56 which is angularly inclined relative to frame axis 20 by an angle of no more than about 45° and preferably by an angle of as little as 30°.

A plurality of intermediate baffles 58*a* through *d* are suitably affixed to the horizontal register plates 52 and distributed between register sides 54 and 56. Each of the baffles includes an angularly inclined portion 60*a* through 60*d* which is parallel to angularly inclined register side 56 and a portion 62*a* through 62*d* which is parallel to straight register sides 54. The straight baffle portion terminates short of an open register exhaust gas intake 64 which faces in an upstream direction relative to the gas stream through duct 4. Consequently, when exhaust gas flows through the duct, a portion thereof enters the register through the intake and then flows through passages 66*a* through 66*d* defined by baffles 58 from the intake at an obliquely inclined angle relative to the burner axis 20 into the trough 26 defined by the flame shield. As is more fully discussed below, oxygen carried by the exhaust gas is utilized to combust the fuel dispersed into the trough by burner 16 so that the burner can be operated with very little primary air.

To assure that the exhaust gas entering the trough through passages 66 is intimately mixed with the flame and contacts all non-combusted fuel droplets, generally V-shaped diffusers 67 are provided. The diffusers extend from passages 66 into the trough and they include upwardly and downwardly inclined wings 69 which diffuse the exhaust gas towards inclined plates 44 of flame shields 22.

To regulate the amount of oxygen supplied to the flame via passages 66 in conformity with the (variable) rate with which fuel is dispersed into flame shield trough 26 by burner 16, the intake 64 of register 50 is provided with dampers 68 such as a pair of vanes 70 rotatably mounted to spaced shafts 72 which may be pivoted from the exterior of the duct via a (schematically illustrated) mechanism 74 so that more or less exhaust gas can be admitted to the register depending upon the load under which the burner operates at any given moment.

Figure 5:
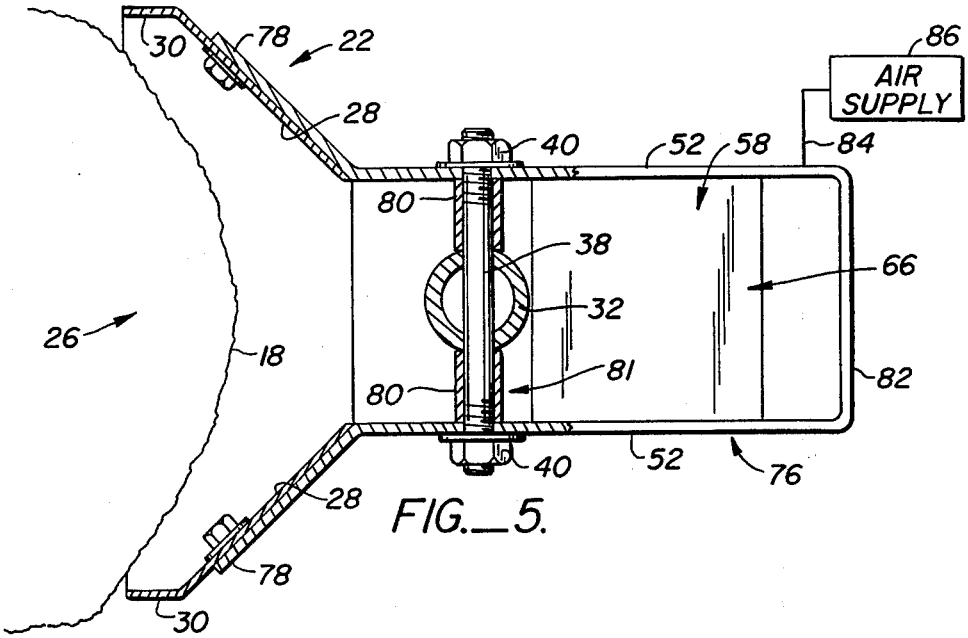
FIG. 5 is a cross-sectional view, similar to FIG. 2, of another flame shield and register constructed in accordance with the present invention.

Referring momentarily to FIG. 5, in an alternative embodiment of the invention, a combustion air register 76 may be substituted for the exhaust gas register 50 illustrated in FIGS. 1–4. The combustion air register is similarly constructed and is again defined by upper and lower, generally horizontal plates 52 which are continuous with inclined flame shield plates 28 although in the illustrated embodiment the flame shield plates are shown to be independent of the register plates and bolted or otherwise affixed to inclined register stubs 78. The flame shield again includes guide plates 30 which are parallel to the exhaust gas streaming through the duct and they form a part of the trough 26 within which flame 18 burns. Studs 38 again secure the register and the flame shield to a support pipe 32 traversing the duct.

Spacers 80 are placed over the studs to maintain the desired flow spaces 81 between the periphery of the pipe and the horizontal register plates 52 and to thereby communicate the interior of the register via passages 66 (constructed as above discussed) with trough 26.

In contrast to the register shown in FIGS. 1–4, however, the upstream facing side of register 76 shown in FIG. 5 is closed with an end wall 82 so that no exhaust gas can enter the register. instead, the register is connected via suitable conduits 84 which extend through the duct walls (not shown in FIG. 5) with a supply 86 of combustion air, e.g. a combustion air fan. In this manner, the combustion oxygen for maintaining the flame in the trough 26 is obtained from air. Although the efficiency of a heater constructed as illustrated in FIG. 5 is reduced because substantial amounts of (cold) air must be heated, this embodiment of the invention is ideally suited for applications in which the exhaust gas might have too little or no oxygen, e.g. for heating low oxygen content flue gases.

Referring again to FIGS. 1–4, in another alternative register 50 may be connected with air supply 86 via (schematically illustrated) conduits 88 extending through the duct wall 80 and a valve 90 so that the exhaust gas may be augmented with combustion air from the air supply in instances in which the exhaust gas includes insufficient oxygen. Further, this arrangement permits the operation of register 50 with either exhaust gas or with air by correspondingly closing and opening register dampers 68 and air valve 90 so that the fuel disbursed into the flame trough 26 by the burner 16 can be effectively and efficiently combusted irrespective of the oxygen content and/or temperature of the exhaust gas, the rate with which fuel is dispersed by the burner, etc. In this manner, the heater of the present invention can be operated over a very wide operating load range which may vary by a factor of as much as 1:10.

For best results, the flame shield 22 is positioned relative to the burner axis 20 so that the distance between the burner axis and the flame shield in the vicinity of the burner is only slightly larger than one-half the diameter of the flame when the burner is operating at full load to avoid direct contact between the flame periphery and the shield while bringing the two together as closely as practical. Further, the guide plates 30 are spaced apart so that their distance over substantially the full length of the flame shield is less than the corresponding diameter of the flame by about 1 to 3 inches so that the flame periphery protrudes into the exhaust gas paths 46 by approximately ½ to 1½".

The operation of the exhaust gas heater 2 of the present invention should now be apparent. To briefly summarize it, heavy fuel oil such as No. 6 oil is flowed to the burner at a metered rate which provides the required energy input to raise the temperature of the exhaust gas to the desired level. Steam or pressurized air is supplied to the burner to atomize the fuel oil and an off-stoichiometric amount of primary air is supplied to the burner in an amount just sufficient to sustain the flame. This minimizes the amount of air that is introduced into the duct and thereby enhances the efficiency of the heater because less cold air needs to be heated. Typically, the burner can be operated with an amount of primary air which supplies no more than 10 to 15% of the total oxygen requirement for a complete combustion of the fuel. The remainder of the necessary oxygen is obtained from the exhaust gas (or air) supplied to the trough via register 50 (or 76) and the passages communicating the interior of the register with the trough.

As the flame burns in the trough, the upstream sides 44 of the flame shields direct the gas stream into paths 46 between adjacent shields and between the outermost face sheilds and the horizontal duct walls 6. It will be observed that the exhaust gas paths 46 are of substantially uniform cross-section and since the peripheral flame portions 42 protrude equally into the paths over substantially their entire length, a uniform heating of the exhaust gas is attained. In addition, the gas flows over the parallel guide plates 30 of the face shields in a substantially laminar, turbulence-free flow and gently slips off the downstream ends off the guide plates. Simultaneously therewith gas from the burning flame, that is gas generated by the flame, the primary and the exhaust gas (or air) entering the register, flow from the trough in a downstream direction and intimately mix with the exhaust gas that has flowed through paths 46. As a result, there are virtually no eddies on the flame side 24 of the shields and a deposit of carbon or soot on the shields is thus prevented. This both enhances the efficiency of the heater and reduces the discharge of pollutants into the atmosphere.

At the same time, of course, the flame shield protects the flame from any substantial direct contact with the gas flow. Accordingly, a deflection of the flame in a downstream direction and a possible extinction of the flame from gases flowing at a high speed is prevented. Instead, the flame is permitted to burn substantially undisturbed by the gas flow. Further, the obliquely inclined register passages 66*a—e* direct the exhaust gas (or air) supplied to the flame in the direction in which the flame burns. This not only eliminates the danger of deflecting the flame in a downstream direction out of the trough, but tends to lengthen the flame so that its extends as far as possible into or across the duct. Under low burner loads when flames may become relatively short, this is particularly helpful to assure a uniform heating of the exhaust gas.

Figure 6:
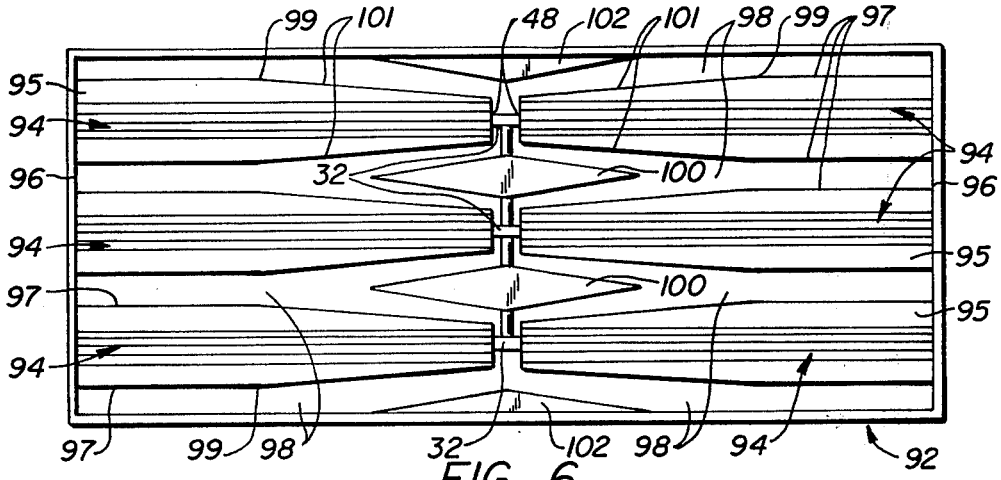
FIG. 6 is a front elevational view, in section, similar to FIG. 1 but illustrates an exhaust gas heater constructed in accordance with the present invention for use in connection with relatively wide exhaust gas ducts.

Referring now momentarily to FIG. 6, in another embodiment of the present invention adapted for use with exhaust gas ducts 92 which are too wide to be completely traversed by a flame, a plurality of burners and associated flame shields (collectively identified in FIG. 6 with reference numeral 94) are mounted in a common plane and in mutual alignment to opposite, vertical duct walls 96. The burners and shields are constructed as set forth above except that a base portion 95 of the shields may have parallel edges 97 from the associated duct wall to a point 99 spaced therefrom. From these points to free ends 48 of the shields shield edges 101 converge, i.e. they are tapered as is shown in FIG. 6. Parallel base edges for the shields are desirable for large ducts to prevent the shield bases from becoming too wide which would encourage the formation of undesirable eddies on the down stream side of the shields and further would make it necessary to form flames with relatively wide flame bases. Wide flame bases, on the other hand, are not normally conducive to the formation of long, pencil-shaped flames.

Further, irrespective of whether or not the shields include straight base portions 95 the free ends 48 of the shields might be relatively narrow due to the length of the shields so that the paths 98 between adjoining shields widen at the points at which the flames are narrowest. Consequently, the exhaust gas flowing through the center portions of the respective paths might be heated to a lesser extent than the portions of the gas flowing through the paths adjacent the duct sides so that the gas temperature may become non-uniform downstream of the heater. To avoid such a non-uniform heating, generally diamond-shaped baffle plates 100 are placed in the center portion of each path so as to reduce the cross-section of the path in that area to thereby correspondingly reduce the gas flow. In this manner, the heating of the gas flow over the entire length of the respective paths can be maintained substantially uniform.

The baffle plate may be mounted in any practical manner as, for example, by suitably attaching them to portions of support pipes 32 between opposing free ends 48 of the flame shields. Further, a half baffle plate 102 may be affixed to the center portion of the horizontal duct walls above and below the uppermost and the lowermost flame shields or the duct walls may be correspondingly contoured to limit the path cross-sections in the described manner. In all other respects, however, the exhaust gas heater 92 illustrated in FIG. 6 is constructed and functions in a manner analogous to that of heater 2 illustrated in FIGS. 1–4.

Figure 11:
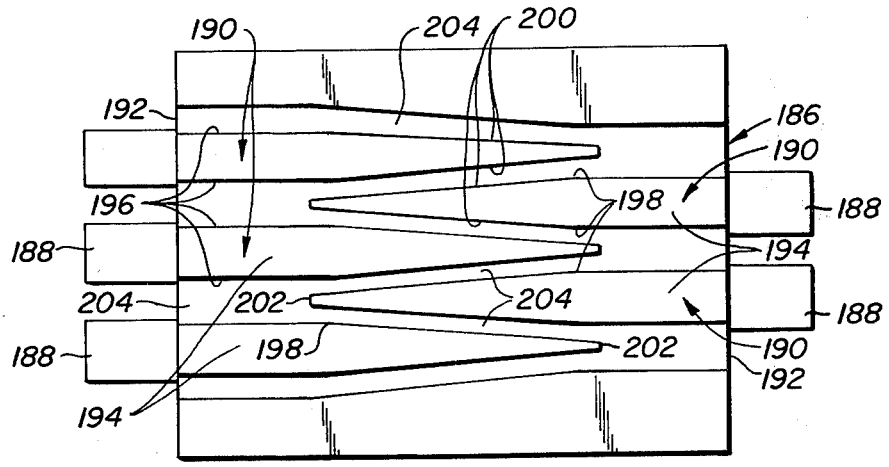
FIG. 11 is a view similar to FIG. 6 but illustrates an arrangement of the flame shields in accordance with a further embodiment of the invention.

Referring momentarily to FIG. 11, in another embodiment of the invention best adapted for use in connection with ducts 186 of intermediate width, that is narrower than the ducts illustrated in FIG. 6 but wider than the duct shown in FIG. 2, a plurality of burners 188 and associated flame shields 190 are mounted to opposing duct walls 192 and arranged so that the shields interleaf. Each shield again includes a base section 194 which has parallel shield edges 196 that extend to a point 198. Tapered shield edges 200 converge from point 198 towards a free end 202 of the shield. To keep passageways 204 between the shield edges of approximately even heights, the tapered shield edges 200 of each shield extend two or slightly beyond the point 198 of the adjacent shield 190 mounted to the opposite duct wall 192. In this manner, a relatively even heating of the exhaust gas flowing through passageways 204 is again achieved without requiring undesirably wide shield bases.

Referring now to FIGS. 4 and 7–9, the exhaust gas heater of the present invention can be operated with any suitable burner which generates a flame of the desired shape, e.g. a relatively long and narrow flame. A particularly advantageous burner, however, is the low pressure burner 104 illustrated in FIGS. 7–9.

Typically, burners which form a long, narrow flame utilize high pressure (primary) air to sustain the combustion of atomized fuel particles and high pressure air to atomize or disburse the fuel since such high pressure air both increases the length of the flame and decreases its width. Such burners, however, require sources of high pressure air which are expensive, noisy and require frequent maintenance.

Figure 9:
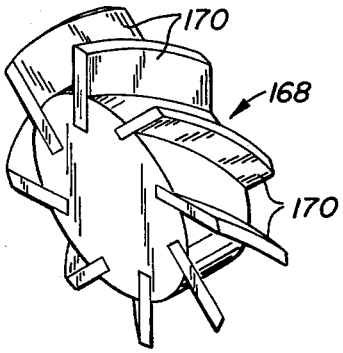
FIG. 9 is a perspective view of a swirl plate used in the nozzle illustrated in FIG. 8.
Figure 7:
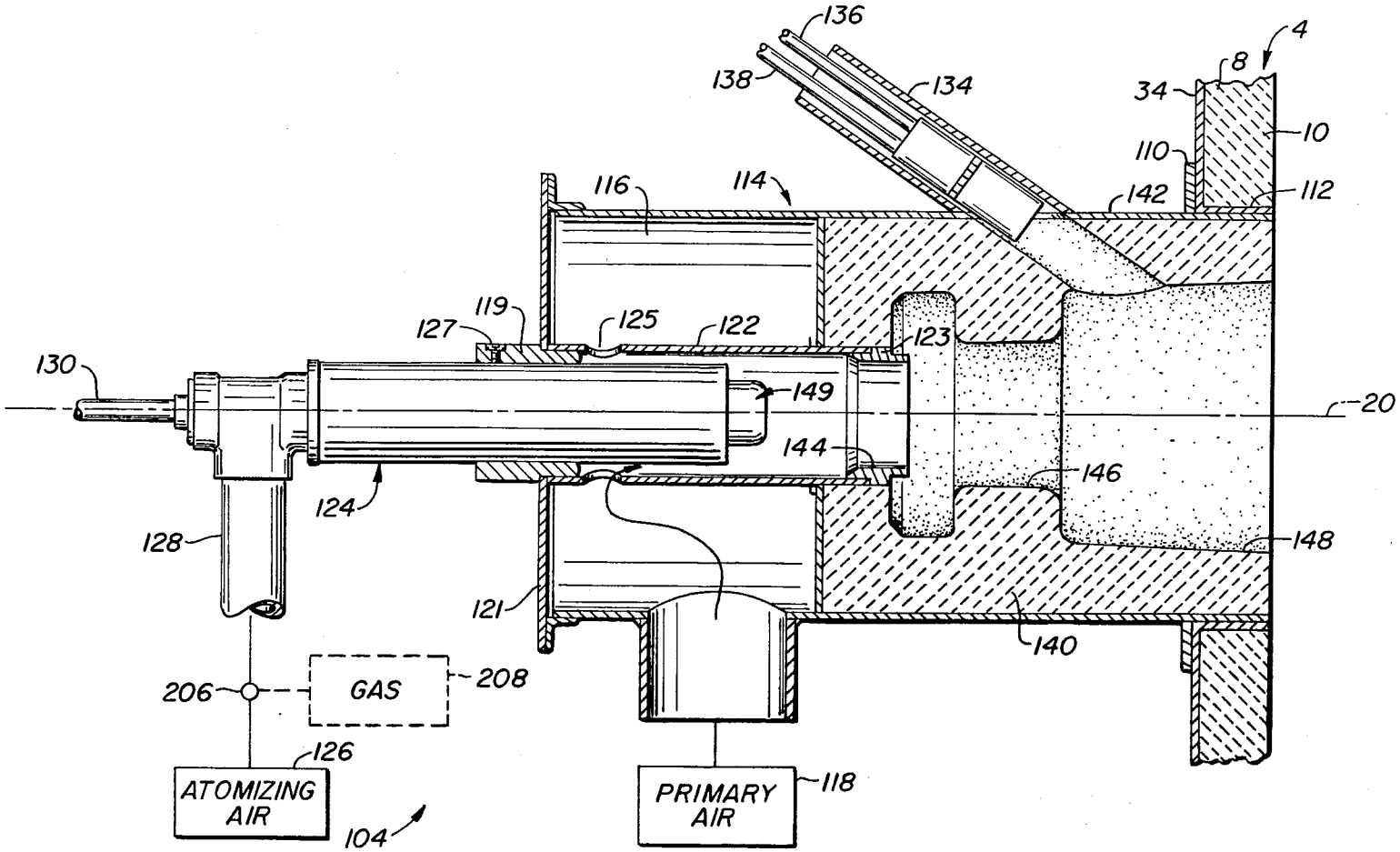
FIG. 7 is a fragmentary, side elevational view of a wall mounted burner utilized by the heater of the present invention.

In contrast thereto, the burner 104 illustrated in FIGS. 7–9 operates with low pressure air, yet it is capable of generating the relatively, narrow, pencil-shaped flame. Typically, the fuel atomizer of such a burner can be operated with air having a pressure no greater than about 4.5 psi above the ambient pressure while the primary air may have a pressure of no more than 0.3 psi above ambient pressure.

In a presently preferred embodiment of the invention, the low pressure burner 104 comprises a self-contained unit which can be inserted into an appropriately shaped opening in upright duct walls 8. A forward end or throat of the burner may be provided with an annular mounting flange 110 that is conventionally secured, e.g. bolted to the exterior duct plate 34. The opening may be lined with a metal sleeve 112 to facilitate the insertion and removal of the burner and to prevent damage to the refractory bricks 10. The burner further includes a housing 114 which projects rearwardly from the throat 108 and which defines a cylindrical primary air chamber 116 in fluid communication with a source of primary air 118 via a suitable flow control valve (not separately shown in FIGS. 7–9).

A liquid fuel atomizing gun 124 is slidably received in a sleeve 119 which extends through an aft cover plate 121 that closes the primary air chamber 116. An air guide tube 122 is disposed concentrically about the atomizing gun and extends from a portion of sleeve 119 protruding into the primary air chamber to a burner throat opening 132 in throat 108. A bushing 123 defines a downstream end of the air guide tube, extends into the throat opening and positions the air guide tube relative thereto. The air guide tube includes a plurality of air inlet apertures 125 located proximate chamber cover plate 121 so that primary air can flow from chamber 116 through inlet apertures 125 into the guide tube. In the guide tube the primary air flow is directionalized parallel to the atomizing gun 124 to avoid undesirable turbulence in the air and atomized fuel flow downstream of the atomizer which might occur if the primary air were deflected through 90° as would be the case if no air guide tube were provided. A more uniform, efficient and relatively emissionfree combustion of the fuel is thereby attained.

A set screw 127 or the like releasably secures the atomizing gun to sleeve 119. By backing off the set screw, the gun is readily withdrawn from the sleeve 119 and thereby from housing 114 for inspection, cleaning, maintenance and the like.

A source of atomizing air 126 such as a regenerative blower provides atomizing air through a conduit 128 to the atomizing gun. Heavy fuel oil such as No. 6 oil is fed to the gun via a tube 130. As is discussed in greater detail below, the atomizing gun forms a mixture of finely dispersed, minute droplets of liquid fuel entering the gun through tube 130 and atomizing air entering through conduit 128 and projects this mixture in a downstream direction through the downstream portion of air guide tube 122 and into the burner throat opening 132. The atomizing air source provides air at a relatively low pressure, generally no greater than about 4.5 psi above ambient pressure. Blowers providing air at pressures as low as 2.5 psi have been found to be sufficient.

An igniter or pilot 134 includes one or more supply tubes 136, 138 and projects into the burner throat opening 132 downstream of atomizing gun 124 to enable the ignition of the mixture and initate combustion. Once combustion has commenced, it is self-sustaining until the supply of fuel through tube 130 is terminated.

The burner throat opening 132 is defined by a refractory element 140 mounted within a sheetmetal housing 142. The opening is contoured over its longitudinal extent so that it forms at least two inwardly projecting steps 144 (in the illustrated embodiment defined by bushing 123) and 146 at a first, upstream stage of the throat. The steps induce eddies in the mixture and the primary air flowing through the throat which facilitate the intimate mixing of the mixture dispersed by atomizing gun 124 and the primary air. The throat opening 132 terminates in an expansion cone 148 which leads directly into the trough 26 (shown in FIG. 2).

The atomizing gun 124 comprises an oil atomizer 149 at a downstream end of the gun, a T-fitting 150 at an upstream end thereof, and an extrusion pipe 151 disposed between and threadably engaging the atomizer and the T-fitting so as to interconnect the two while spacing them apart.

A plug 152 threadably engages the upstream oriented opening of the T-fitting and it includes a fuel passage 154, the upstream end of which is threaded for connection to a correspondingly threaded end of fuel tube 130. The downstream end of fuel passage 154 is similarly threaded and threadably receives an end of a fuel supply conduit 153 which extends in a downstream direction to the vicinity of oil atomizer 149. The downstream end of the fuel conduit threadably mounts an oil discharge nozzle 155 which extends into the atomizer as is more fully described below.

The atomizer 149 comprises a generally cylindrical housing, the upstream end of which is threaded onto the downstream end of extension pipe 151. A generally cylindrical, tubular central core member 156 includes a radially outwardly protruding flange 159 at its upstream end which is clamped between the opposing surfaces defined by the downstream end of extension pipe 151 and an inwardly protruding ridge 161 of the housing 157 so that the interior of the core member is in fluid communication with the interior of extension pipe 151. The core member includes a plurality of apertures 160 adjacent an upstream end thereof to permit atomizing air form air source 126 to flow via the fitting 150, the interior of extension pipe 151 and the interior of core member 156 into an annular passage 158 between the exterior of the core member and the interior of housing 157. As is set forth in greater detail below, part of the air flowing into the interior of core member continues through the core member in a downstream direction.

A hollow insert 164 is disposed within core member 156 and forms a venturi section 166 where the fuel oil issuing from nozzle 155 is mixed with the atomizing air.

A stationary swirl plate 168 (shown in detail in FIG. 9) is disposed within core member 156 and facilitates the mixing of fuel oil with the atomizing air. The swirl plate has a plurality of circumferentially disposed vanes 170 which impart a swirling motion to the mixture.

A cap 176 threadably engages the downstream end of the housing 157 and includes a co-axial aperture 178 which extends from the exterior of the cap to an interior, tapered surface 180. The downstream end of core member 156 is provided with a corresponding, inwardly tapered surface 182 which cooperates with tapered cap surface 110 to form a radially inwardly converging passageway 184 which communicates with the annular passage 158. Consequently, atomizing air not only enters venturi section 166, but a secondary supply of atomizing air is provided through apertures 160 into the inclined passageway 184. This secondary supply of atomizing air provides an "air cushion" at the tip of the atomizer and minimizes the fouling of the atomizer tip by fuel oil deposits.

In operation, low pressure primary air from primary air source 118 continuously flows through air-chamber 116 of housing 114 guide tube apertures 125 and guide tube 122 into burner throat 132. The fuel oil-atomizing air mixture is injected into the stream of primary air in the guide tube along burner axis 20 and just upstream of the throat opening.

The mixture ignites within flame throat 132. The steps 144, 146 induce a sequence of longitudinally spaced eddies which enhance the mixing of the fuel oil-atomizing air mixture with primary air to obtain satisfactory combustion.

As was discussed earlier, the amount of primary air and atomizing air is selected so that it is just sufficient to sustain the combustion of the fuel. In a typical case in which the exhaust gas flowing through duct 4 comprises turbine exhaust gas having an oxygen content of approximately 14%, the primary and atomizing air flows are regulated so that they each supply between about 10 to about 15% of the overall oxygen requirement for the complete combustion of all fuel introduced through the burner. The remainder of the necessary combustion oxygen is obtained from the turbine exhaust gas (or combustion air) directed to the flame trough 26 via register 50 and passages 66 as was described above.

The atomizing gun 124 of the present invention is particularly well adapted for use with wall mounted duct burners. As above indicated, its elongate configuration makes it possible to insert the gun axially through the cover plate 121 of primary air chamber 116. This greatly facilitates the ease with which the axial position of the atomizer 149 is adjusted as well as the maintenance, cleaning and replacement of the atomizer if and when that is required. Although such a construction makes it necessary to feed primary air into the chamber 116 generally transversely to the flame direction, the provision of the primary air guide tube 122 directionalizes the primary air flow parallel to the flame before it contacts the atomized fuel mixture and thereby prevents adverse effects which might otherwise be encountered due to turbulence and the like in the vicinity of the atomizer. Further, the atomizer in conjunction with the above-described configuration of the burner throat 132 yields an elongate, pencil-shaped flame which reaches deep into the duct 4 while the nozzle can be operated with relatively very low atomizing and primary air pressures. This in turn reduces the complexity of the air supply and, thereby, the overall costs of the heater.

For instances in which it may become desirable to operate the duct heater from time to time with gas, or to supplement the oil firing of the heater with gaseous fuel (hereinafter "gas") to help accommodate peak loads or for other reasons, the burner 104 illustrated in FIGS. 7 and 8 can be operated as a gas burner, or as a combined oil and gas burner by providing a valve 206 which alternatively connects conduit 128 with the atomizing air source 126 or with a gas source 208. If, for example, the burner is operated with oil and it is desired to augment the fuel supply with gas, valve 206 can be operated to connect conduit 128 with the gas source. In such an event, the fuel oil entering the oil atomizer 149 is atomized with gas rather than air. Corresponding adjustments in the supply of primary air from air source 118 must, of course, be made in a conventional manner.

Further, the burner 104 may be switched over to gas operation only again by operating valve 206 to connect conduit 128 with gas source 208. At the same time, the fuel oil supply is turned off so that any residual oil entering the oil atomizer 149 is atomized by gas but the burner as a whole thereafter continues to be fired by gas only.

An advantage of this arrangement is that it not only enables the substitution of one fuel for another, but that the substitution can be accomplished without interruption in the firing of the burner.

Figure 10:
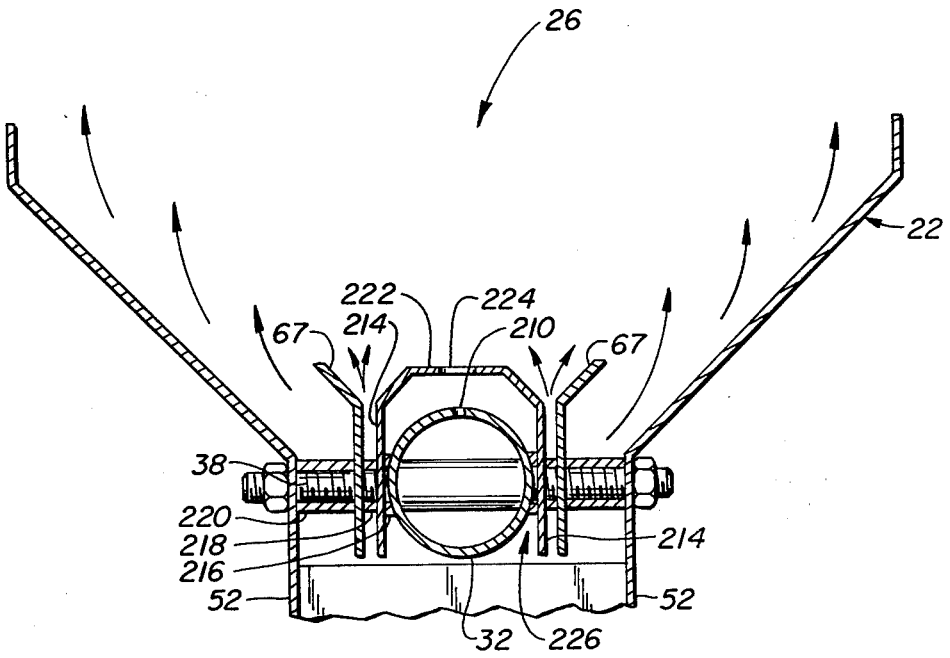
FIG. 10 is a schematic side elevational view, in section, of a flame shield similar to the one illustrated in FIG. 2 but capable of being fired with gas.

Referring now to FIG. 10, in a further alternative for firing the duct heater with gas as a substitute for or augmentation of the oil firing burner, shield support pipe 32 may be utilized as a gas supply conduit by appropriately connecting the tube to a source of gas (not shown in FIG. 10). The downstream facing side of the support tube is provided with a multiplicity of gas discharge openings 210 which are distributed over the length of the pipe. A U-shaped flame stabilizer 212 is placed over the gas supply-shield support pipe 32. The stabilizer is defined by a pair of parallel legs 214 secured to studs 38 and appropriately spaced from the pipe, diffusers 67 and horizontal shield plates 52 with appropriately dimensioned bushing 216, 218 and 220 which are placed over the stud. A web 222 interconnecting the stabilizer legs 214 faces in a downstream direction and includes gas discharge apertures 224 which are of a larger diameter than the gas discharge openings in pipe 32 so as to permit gas to progress unimpededly from the pipe past the stabilizer into the trough 26 defined by flame shield 22. The stabilizer is constructed so that a space 226 between support pipe 32 and stabilizer legs 214 permits a primary combustion air flow for mixing the flow with gas issuing from gas discharge opening 210 before the resulting mixture exits from gas discharge apertures 224 in the stabilizer.

In all other respects the flame shield illustrated in FIG. 10 is constructed and operates in the same manner in which the flame shields illustrated in FIGS. 1–5 as constructed and operate except, of course, that the firing may alternatively be done with oil or gas or the oil firing may be augmented with gas firing if and when such augmentation appears desirable.

We claim:

1. Apparatus for heating a gas flowing through a duct defined by opposing duct walls which are generally parallel to the gas flow direction, the apparatus comprising: at least one burner means for producing an elongate, pencil-shaped flame having a diameter near the burner which is larger than the diameter remote from the burner, said burner means including means for mounting the burner means to the wall so that the burner means forms a flame extending into the duct transversely to the gas flow direction; and a means for shielding the flame including means for mounting the shield means to a wall of the duct so that the shield means is positioned upstream of the flame and extends generally parallel to the flame into the duct, the shield having a lateral extent in a direction transverse to the gas flow which is relatively large at a base of the shield proximate the burner and which is relatively small adjacent an end of the shield remote from the burner so that the shield defines a trough protecting the flame from the gas flow through the duct which has a shape approximating the shape of the flame, the shield means having a passage therethrough for directing combustion sustaining oxygen to the flame, said passage being disposed axially along the shield means so that the gas flow impinges along substantially the entire length of the flame.

2. Apparatus according to claim 1 including another burner means mounted to a second duct wall opposite the first wall, and a second flame shield means constructed analogously to the first mentioned flame shield, the base of the second flame shield being proximate the free end of the first mentioned flame shield and the free end of the second flame shield being proximate the base of the first mentioned flame shield.

3. Apparatus according to claim 2 wherein adjacent flame shield means have proximate, opposing but spaced apart edges which are substantially parallel to each other.

4. Apparatus according to claim 3 wherein at least a portion of the edges of each shield means converge toward the free end of the shield means.

5. Apparatus according to claim 4 wherein another portion of each shield means proximate its base has substantially parallel edges which are contiguous with the converging edges.

6. Apparatus according to claim 1 including means in fluid communication with the passage for varying the amount of gas directed through the flame shield means to the flame.

7. Apparatus according to claim 6 wherein the varying means comprises means defining a gas chamber protruding in an upstream direction from an upstream side of the flame shield means and defining a gas intake which faces in an upstream direction so that gas flowing through the duct can flow into the gas chamber and hence through the passage of the flame, and means defining a damper for regulating the gas flow into the chamber.

8. Apparatus according to claim 7 including means in fluid communication with the passage and with the gas chamber for orienting gas flowing through the chamber and through the passage so that the gas exits from the passage in the direction of the longitudinal extent of the flame.

9. Apparatus according to claim 8 wherein the orienting means direct the gas exiting from the passage at an angle of no more than about 45° to the axis of the flame.

10. Apparatus according to claim 9 wherein the angle is no more than about 30°.

11. Apparatus according to claim 1 including an air plenum protruding in an upstream direction from an upstream side of the flame shield means, the plenum being in fluid communication with the passage, and including means for supplying the plenum with combustion air from outside the duct.

12. Apparatus according to claim 11 wherein the plenum includes means for also directing a portion of the gas flowing in the duct into the plenum so that gas and combustion air can be discharged through the passages.

13. Apparatus according to claim 12 including means for regulating the amount of gas directed into the plenum and means for regulating the amount of combustion air directed into the plenum.

14. Apparatus for heating an exhaust gas comprising in combination: a duct defined by opposing duct walls through which the exhaust gas can flow; first and second burners mounted to opposing duct walls and including fuel oil atomizing means for discharging fuel oil in a manner which forms a flame that extends transversely to the gas flow, each flame having a relatively elongate, pencil-like shape and a predetermined, cross-sectional extent in a direction perpendicular to the gas flow; a means for shielding the flame associated with each burner and mounted to the duct walls, each flame shield means being positioned upstream of the associated burner and forming a trough for each flame which is protected from the gas flow by the shield, each shield means further having an outline in the flow direction of the gas flow which approximates the shape of the flame and which is selected so that a portion of the shield facing the gas flow has a width in a direction perpendicular to the gas flow which is less than the cross-sectional extent of an associated part of the flame so that peripheral sections of the flame extend beyond the shield, adjoining shield means further having proximate edges which are spaced apart so as to define unobstructed paths between adjacent shield means which permit gas flowing through the paths to intersect the peripheral flame sections; additional means associated with each flame shield for defining an elongate passage for flowing flame combustion sustaining oxygen through the shield means, said passage being disposed axially intermediate its respective longitudinal ends, from an upstream side of the shield to the trough, and means for regulating the amount of combustion sustaining oxygen which flows through the passage; whereby the flame in the trough is sustained with oxygen entering the trough through the passage and the formation of gas flow eddies in the trough and resulting carbon deposits are substantially prevented; and whereby the gas flow is further substantially evenly heated over its full cross-section to prevent the formation of hot spots in the gas flow downstream of the burners.

15. Apparatus according to claim 14 including baffle plate means disposed within the duct and shaped and positioned relative to the paths so as to prevent flows of substantial amounts of gas through sections of the paths which are not contiguous with peripheral sections of the flame.

16. Apparatus according to claim 15 wherein the flame shield means terminate in free ends proximate an interior of the duct, and wherein the baffle plate means comprises plates positioned in the paths defined by free ends of adjacent shields to thereby limit the flow of gas through portions of the paths in the vicinity of the free shield ends to assure a substantially even heating of the entire gas stream flowing through the duct.

17. Apparatus according to claim 14 wherein a flame shield means, in cross-section, has a substantially V-shaped configuration defined by angularly inclined plates having a downstream facing side defining the trough, and including means interconnecting the downstream facing side of the inclined plate with upstream facing side of the plate and defining the passage therebetween.

18. Apparatus according to claim 17 wherein the interconnecting means includes means for diffusing oxygen entering through the passage over substantially the full cross-section of the trough defined by the inclined plates.

19. Apparatus according to claim 18 including means defining a hollow compartment in fluid communication with the passage and located upstream of the inclined plates and admitting means in fluid communication with the compartment for flowing the oxygen into the compartment and hence through the passage to the flame.

20. Apparatus according to claim 19 wherein the oxygen flowing through the passage is included in the exhaust gas flow, and wherein the admitting means comprises a gas intake in the compartment defining means, the intake facing in an upstream direction so that a portion of the gas fow in the duct can enter the compartment and flows in a downstream direction through the passage to the trough while a remainder of the gas flows in a downstream direction about the inclined plates through the paths.

21. Apparatus according to claim 20 including damper means positioned in the intake for regulating the amount of gas which can enter the chamber and which can hence flow through the passage to the trough.

22. Apparatus according to claim 19 wherein the admitting means comprises means for flowing combustion air from an exterior of the duct into the compartment.

23. Apparatus according to claim 22 wherein the admitting means further comprises means for flowing a portion of the gas flow into the chamber and including means for regulating the relative amount of gas and of combustion air which can flow into the chamber.

24. Apparatus according to claim 14 including means for directing oxygen issuing from the passage in the direction of the flame burning in the trough and at an oblique angle with respect thereto.

25. Apparatus according to claim 14 wherein each nozzle includes means for supplying the nozzle with fuel oil and means for supplying the nozzle with oil atomizing air, and wherein the nozzle further includes means for atomizing the oil with the air to form a resulting mixture of atomized oil and air, and a swirl plate located within the nozzle and having a plurality of circumferentially spaced, inclined blades in the path of the mixture adapted to impart rotational motion to the mixture about the axis of the nozzle.

26. Apparatus according to claim 25 wherein the means for supplying atomizing air includes means for supplying the air at a pressure of no more than about 4.5 lbs. per sq. in. above ambient pressure.

27. Apparatus according to claim 25 wherein the nozzle includes means for injecting a circumferential cushion of air circumscribing the mixture at an outlet end of the nozzle, the injecting means including means for injecting the air at an oblique angle relative to the nozzle axis to minimize the pressure drop of the injected air.

28. Apparatus according to claim 25 wherein the burner further includes a flame throat extending through the duct wall and projecting from about an end of the nozzle towards the interior of the duct, the throat including at least two axially spaced steps to induce and control the location of eddies forming in the mixture discharged from the nozzle and propagating through the throat into the associated trough in the duct.

29. Apparatus according to claim 14 wherein each nozzle is defined by an oil atomizing gun comprising an oil atomizer defining a downstream end of the gun located proximate the associated duct wall, means located at an upstream end of the gun defining an oil intake port and an atomizing air inlet, and extension means interconnecting and spacing apart the oil atomizer and the means defining the port and the inlet, the extension means including means for independent flowing oil and atomizing air from the port and the inlet, respectively, to the atomizer.

30. Apparatus according to claim 29 wherein the means for independently communicating comprises first and second concentric tubular members.

31. Apparatus according to claim 30 including a burner housing for each nozzle attached to the associated duct wall, the housing defining a flame throat opening in a downstream end thereof communicating with an interior of the duct and a primary air chamber located upstream of the flame throat opening, the housing further including a cover having a cutout concentric with the flame throat opening and means for receiving the fuel atomizing gun through the cutout and for locating the fuel atomizer within the housing in alignment with the flame throat opening and generally upstream thereof.

32. Apparatus according to claim 31 including a primary air inlet communicating with the chamber and extending from the housing generally transversely to the flame throat opening, and an air guide tube extending from the flame throat opening in a generally upstream direction and enveloping at least a portion of the oil atomizer from which atomized oil is discharged, the tube defining a passage through which primary air from the chamber can flow generally parallel to the flame throat opening past said portion and into the throat opening.

33. Apparatus according to claim 32 wherein the air guide tube extends to and is supported by the cover, and wherein the passage is defined by an aperture formed in the tube at a location upstream of said atomizer portion.

34. Apparatus according to claim 25 wherein the means for supplying the nozzle with oil atomizing air includes a conduit and a source of atomizing air; and further including a source of a gaseous fuel; and valve means operatively coupled with the conduit, the atomizing air source and the gaseous fuel source for alternatively flowing through the conduit air or gaseous fuel so that the burners can be operated with fuel oil only fuel oil and gaseous fuel, or gaseous fuel only.

35. Apparatus according to claim 14 including a tubular support member for each flame shield anchored to at least one duct wall, extending over the full length of the associated shield and positioned so as to communicate with the trough formed by the shield, means connecting the interior of the tubular support member with a source of gaseous fuel, the support member further including a plurality of gas discharge openings distributed over at least a portion of its length and oriented to discharge gas into the trough so that discharged gas is ignited in the trough and heats the exhaust gas.

36. Apparatus according to claim 35 including a flame stabilizer positioned between the trough and the tubular member, the flame stabilizer defining a web oriented generally perpendicular to the exhaust gas flow through the duct and including gas discharge apertures aligned with the gas discharge openings in the member so that gaseous fuel from the member can exit through the openings and the apertures into the trough.

37. Apparatus for heating of an exhaust gas stream comprising in combination: a duct defined by opposing duct walls through which the exhaust gas stream can flow; a plurality of burner means each for producing an elongate flame having a controlled outline with a base of the flame adjacent the burner having a transverse extent greater than a transverse extent of an end of the flame remote from the burner, said burner means being mounted to opposing duct walls, each burner means including a nozzle having an axis oriented transversely to the duct and means for mixing fuel discharged by the nozzle with primary combustion air and for flowing a resulting fuel-air mixture transversely to the exhaust gas stream into the duct towards the opposing duct wall; means for mounting the burner means in a substantially common plane, adjacent burner means in such plane being alternatively mounted to the opposing duct walls so as to interleave the flames formed by such burner means; shield means for each burner positioned relative to the gas stream on the upstream side of the burner to define a flame trough which is open in a downstream direction, the shield means having an outline approximating the outline of the flame so that edges of the shield means extending transversely to the gas stream flowing in the duct are proximate the flame outline, the shield means for the burners being further sized so as to define between them substantially like paths through which the exhaust gas stream can flow to assure an even heating of the exhaust gas stream flowing through such paths; means for anchoring the shield means to the duct; and supply means connected with the shield means for supplying the trough with sufficient oxygen to assure the substantially complete combustion of the fuel introduced into the trough.

38. Apparatus according to claim 37 wherein the oxygen for the combustion of the fuel in the trough is obtained from the exhaust gas stream, and wherein the supply means comprises means for flowing a portion of the exhaust gas stream past passages defined in the shield means to the trough.

39. Apparatus according to claim 38 wherein the oxygen for the combustion of the fuel in the trough is obtained from air exteriorly of the duct, and wherein the supply means includes means for flowing the air past the passages in the shield means to the trough.

40. Apparatus according to claim 37 wherein the distance between a center of the nozzle and a wall defined by the shield means and facing in a downstream direction is slightly larger than one-half the diameter of the flame base.

41. Apparatus for heating an exhaust gas comprising in combination: a dust defined by opposing duct walls through which the exhaust gas can flow; a burner means for forming a flame that extends transversely to the gas stream into the duct, said means mounted to a duct wall and including a fuel oil atomizing nozzle; a means for shielding the flame mounted to the duct and positioned upstream of the burner for forming a trough within which the flame can burn and which protects the flame from the gas flowing in the duct; register means disposed upstream of the shield for collecting a gas including oxygen, the register means being disposed within the duct; means defining a passage communicating the trough with the register means so that the gas including the oxygen can flow from the register means to the trough and the oxygen can sustain the combustion of fuel oil in the trough; and means for regulating the rate with which the gas including the oxygen flows through the passage as a function of the rate with which fuel oil is discharged by the nozzle to assure a substantially complete combustion of all fuel oil discharged by the nozzle.

42. Apparatus according to claim 41 wherein the regulating means comprises means for regulating the rate with which the gas including oxygen enters the register means.

43. Apparatus according to claim 41 wherein the register means includes an opening disposed within the duct and facing in an upstream direction relative to the gas flow through the duct for collecting exhaust gas in the register means, and wherein the gas including the oxygen comprises exhaust gas.

44. A method for heating an exhaust gas stream flowing through a duct defined by opposing walls comprising the steps of: generating an elongated flame of a well-defined outline with a fuel and an off-stoichiometric amount of primary combustion air; directing the flame transversely to the exhaust gas stream from one duct wall towards the other duct wall by forming a mixture of fuel and primary air in an amount substantially less than the required amount of air to fully combust the fuel by directing such mixture into the duct; defining a first path for a plurality of exhaust gas streams which path substantially intersects the periphery of the flame and generally follows a longitudinal contour of the flame; defining a second path which leads directly into the flame and passes a portion of the exhaust gas along the length of the flame; and controlling the extent of the portion so that the portion furnishes the flame with sufficient oxygen to effect the substantially complete combustion of all fuel in the mixture directed into the duct; whereby the exhaust gas can be heated to the desired temperature with a minimum amount of additional air and is substantially uniformly heated and the formation of hotspots in the exhaust gas downstream of the flame is prevented.

45. A method according to claim 44 including the step of varying the amount of fuel in the mixture, and correspondingly varying the portion of exhaust gas flowing directly into the flame.

46. A method according to claim 44 including the step of deflecting the portion of the exhaust gas from the exhaust gas stream in the duct in the direction in which the fuel-primary air mixture enters the duct and at an oblique angle in regard thereto.

47. A method according to claim 43 including the step of shaping the mixture so that the flame has a generally conical shape, wherein said first path leads one of the exhaust gas streams to peripheral portions of the flame at generally diametrically opposed sections of the flame along inclined path boundaries which are generally parallel to the conical shape of the flame.

* * * * *